United States Patent [19]

Messori

[11] 4,455,132

[45] Jun. 19, 1984

[54] VOLUMETRIC COMPRESSOR OF THE ROOTS TYPE

[75] Inventor: Pier P. Messori, Pino Torinese, Italy

[73] Assignee: Fiat Auto S.p.A., Turin, Italy

[21] Appl. No.: 468,839

[22] Filed: Feb. 23, 1983

[30] Foreign Application Priority Data

Feb. 23, 1982 [IT] Italy ..... 67192 A/82

[51] Int. Cl.[3] ..... F01C 1/18; F01C 1/24

[52] U.S. Cl. ..... 418/206

[58] Field of Search ..... 418/150, 191, 206, 201

[56] References Cited

U.S. PATENT DOCUMENTS

| | | | |
|---|---|---|---|
| 3,056,355 | 10/1962 | Brun | 418/206 |
| 3,089,638 | 5/1963 | Rose | 418/206 |
| 3,371,856 | 3/1968 | Thelen | 418/206 |
| 3,817,667 | 6/1974 | Winkelstrater | 418/206 |
| 4,227,869 | 10/1980 | Eriksson | 418/206 |

*Primary Examiner*—Leonard E. Smith
*Assistant Examiner*—Jane E. Obee
*Attorney, Agent, or Firm*—Sughrue, Mion, Zinn, Macpeak and Seas

[57] ABSTRACT

A Roots-type rotary volumetric compressor with two double-lobed rotors in which, for each of the four quadrants defined by the major and minor axes of the rotor, each rotor has a particular profile constituted by seven arcs of circles which extend from the point of intersection with the minor axis to the point of intersection with the major axis. The coordinates of the respective centers of curvature ($C_1$ to $C_7$) of the arcs in a frame of reference having its origin at the center of the rotor and its axes of the asbcissae (X) and ordinates (Y) coincident with the minor and major axes of the rotor, and the values of the respective radii of curvature ($R_1$ to $R_7$), are given. The arcs have respective angular extents ($A_1$ to $A_7$) of substantially 12°, 40°, 1°, 29°, 88°, 13° and 6°.

2 Claims, 2 Drawing Figures

VOLUMETRIC COMPRESSOR OF THE ROOTS TYPE

The present invention relates to a Roots-type rotary volumetric compressor with double-lobed rotors.

The object of the invention is to provide a compressor of this type which has a simple and economical construction, and a high efficiency.

In order to achieve this object, the present invention provides a compressor of the aforesaid type, in which each rotor has a profile which, for each of the four quadrants defined by the major and minor axes of the rotor, is constituted by seven arcs of circles extending from the point of intersection with the minor axis to the point of intersection with the major axis, and in which the coordinates ($XC_1$ to $XC_7$; $YC_1$ to $YC_7$) of the respective centres of curvature ($C_1$ to $C_7$) of the arcs in a frame of reference having its origin at the centre of the rotor, its axis of the abscissae (X) coincident with a minor semi-axis of the rotor, and its axis of the ordinates (Y) coincident with a major semi-axis of the rotor, and the values of the respective radii of curvature ($R_1$ to $R_7$) of the arcs, are as follows:

$XC_1=0.538972$ d;
$YC_1=0$;
$R_1=0.354967$ d;
$XC_2=0.581260$ d;
$YC_2=-0.005147$ d;
$R_2=0.397564$ d;
$XC_3=-0.671833$ d;
$YC_3=1.311256$ d;
$R_3=1.419868$ d;
$XC_4=0.239369$ d;
$YC_4=0.379889$ d;
$R_4=0.116903$ d;
$XC_5=0$;
$YC_5=0.449147$ d;
$R_5=0.366084$ d;
$XC_6=0.070711$ d;
$YC_6=0.661797$ d;
$R_6=0.141988$ d;
$XC_7=0$;
$YC_7=0$;
$R_7=0.807550$ d;

Research and experiments conducted by the applicants have shown that the profiles of the two rotors of the compressor according to the invention, while not mating precisely, simplify and reduce the cost of the manufacture of the rotors, as well as giving the compressor a high cubic capacity for a given external bulk and allowing small values of clearance between the two rotors to be maintained during operation of the compressor.

Figure 1:
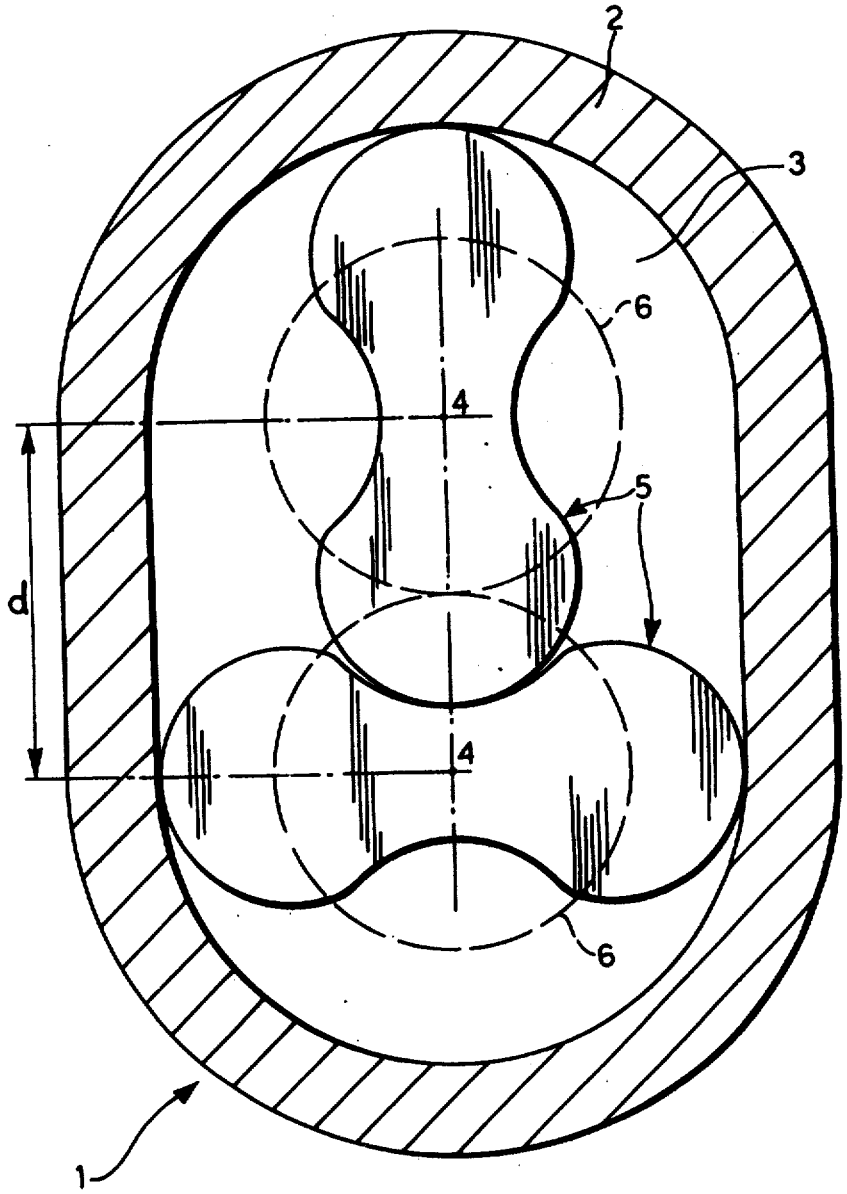
Figure 2:
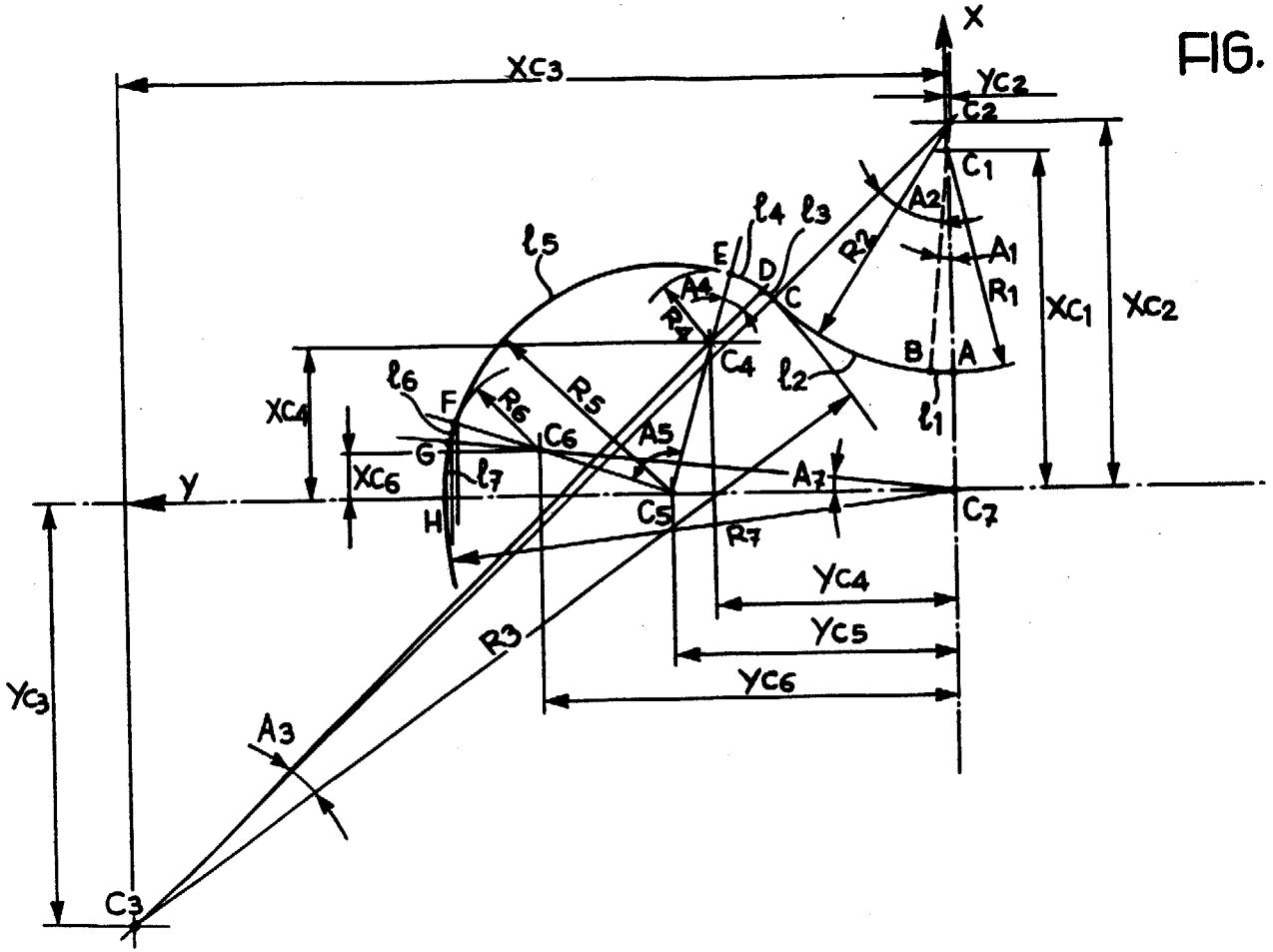

The present invention will now be described, by way of non-limiting example, with reference to the appended drawings, in which:

FIG. 1 is a schematic view of a compressor according to the present invention, and FIG. 2 illustrates a detail of the profile of one of the two rotors of the compressor of FIG. 1.

FIG. 1 illustrates a Roots-type volumetric rotary compressor 1 which includes a casing 2 defining a cavity 3 within which two double-lobed rotors 5 are mounted for rotation about two parallel axes 4.

In a known manner, the two rotors 5 are connected for rotation with two meshing gear wheels of equal diameter, the base circles 6 of which are illustrated in FIG. 1. Clearly, the base diameter of each of these gear wheels corresponds to the distance d between the two axes of rotation 4 of the rotors 5.

The compressor described herein is intended particularly for the super-charging of an internal combustion engine.

The research and experiments carried out by the applicants have resulted in the determination of a particular profile for each of the rotors 5 (which are identical to each other) that allows the manufacture of the rotors to be simplified and made more economical, and, at the same time, allows high values for the cubic capacity to be achieved for a given external bulk and small values of clearance between the two rotors to be maintained during operation of the compressor.

The profile of the present invention is shown in FIG. 2. For simplicity, this drawing illustrates only that part of the profile of one rotor 5 which lies in one of the four quadrants defined by the major and minor axes of the rotor. The parts of the profile in the three remaining quadrants are, of course, identical and symmetrical with those of the adjacent quadrants.

According to the present invention, the part of profile illustrated in FIG. 2 is constituted by seven arcs of circles $l_1,l_2,l_3,l_4,l_5,l_6,l_7$, respectively. The ends of these seven arcs are indicated A,B,C,D,E,F,G,H respectively, starting from the point of intersection A with the minor axis of the rotor and ending at the point of intersection H with the major axis of the rotor. The seven arcs $l_1,l_2,l_3,l_4,l_5$, $l_6$, $l_7$ have respective centres of curvature $C_1,C_2,C_3,C_4,C_5,C_6,C_7$.

In a frame of reference having its origin at the centre of the rotor and its respective axes X, Y of the abscissae and ordinates coinciding with a minor semi-axis and a major semi-axis of the rotor, the coordinates of the centres of curvature $C_1,C_2,C_3,C_4,C_5,C_6,C_7$ are as follows:

$XC_1=0.538972$ d; $YC_1=0$; $XC_2=0.581260$ d; $YC_2=-0.005147$ d; $XC_3=-0.671833$ d; $YC_3=1.311256$ d; $XC_4=0.239369$ d; $YC_4=0.379889$ d; $XC_5=0$; $YC_5=0.449147$ d; $XC_6=0.070711$ d; $YC_6=0.661797$ d; $XC_7=0$; $YC_7=0$.

As specified above, d is the distance between the two axes of rotation 4 of the two rotors 5.

The respective radii of curvature of the seven arcs $l_1,l_2,l_3,l_4,l_5,l_6,l_7$ are as follows:

$R_1=0.354967$ d; $R_2=0.397564$ d; $R_3=1.419868$ d; $R_4=0.116903$ d; $R_5=0.366084$ d; $R_6=0.141988$ d; $R_7=0.807550$ d.

As shown in FIG. 2, the arcs $l_1,l_2,l_3,l_4,l_5,l_6,l_7$ have respective angular extents $A_1,A_2,A_3,A_4,A_5,A_6,A_7$ with substantially the following values:

$A_1=12°$; $A_2=40°$; $A_3=1°$; $A_4=29°$; $A_5=88°$; $A_6=13°$; $A_7=6°$.

In a practical embodiment made by the applicants, the distance d between the axes of rotation 4 of the two rotors 5 is 56.885 mm, and the minor and major semi-axes of each rotor have lengths of 10.467 mm and 91.875 mm respectively.

What is claimed is:

1. A rotary volumetric compressor of the Roots type, including two double-lobed rotors with respective axes of rotation and respective major and minor axes, wherein each rotor has a profile which, for each of the four quadrants defined by the major and minor axes of the rotor, is constituted by seven arcs of circles extending from the point of intersection with the minor axis to the point of intersection with the major axis, and wherein the coordinates ($XC_1$ to $XC_7$; $YC_1$ to $YC_7$) of the respective centres of curvature ($C_1$ to $C_7$) of the arcs in a frame of reference having its origin at the centre of the rotor, its axis of the abscissae (X) coincident with a minor semi-axis of the rotor, and its axis of the ordinates (Y) coincident with a major semi-axis of the rotor, and the values of the respective radii of curvature ($R_1$ to $R_7$) of the arcs, are as follows:

$XC_1=0.538972$ d;
$YC_1=0$;
$R_1=0.354967$ d;
$XC_2=0.581260$ d;
$YC_2=-0.005147$ d;
$R_2=0.397564$ d;
$YC_3=-0.671833$
$YC_3=1.311256$ d;
$R_3=1.419868$ d;
$XC_4=0.239369$ d;
$YC_4=0.379889$ d;
$R_4=0.116903$ d;
$XC_5=0$;
$YC_5=0.449147$ d;
$R_5=0.366084$ d;
$XC_6=0.070711$ d;
$YC_6=0.661797$ d;
$R_6=0.141988$ d;
$XC_7=0$;
$YC_7=0$;
$R_7=0.807550$ d;

where d is the distance between the axes of rotation of the two rotors.

2. A compressor as defined in claim 1, wherein the respective angular extents ($A_1$ to $A_7$) of the seven arcs have substantially the following values:

$A_1=12°$; $A_2=40°$; $A_3=1°$; $A_4=29°$; $A_5=88°$; $A_6=13°$; $A_7=6°$.

* * * * *